United States Patent [19]

Kimura et al.

[11] Patent Number: 4,810,465

[45] Date of Patent: Mar. 7, 1989

[54] FREE-CUTTING TI ALLOY

[75] Inventors: Atsuyoshi Kimura, Nagashima; Sadayuki Nakamura, Asahi, both of Japan

[73] Assignee: Daido Tokushuko Kabushiki Kaisha, Aichi, Japan

[21] Appl. No.: 12,527

[22] Filed: Feb. 9, 1987

Related U.S. Application Data

[63] Continuation-in-part of Ser. No. 849,979, Apr. 10, 1986, abandoned.

[30] Foreign Application Priority Data

Apr. 12, 1985 [JP] Japan ..... 60-77975
Oct. 16, 1985 [JP] Japan ..... 60-230264

[51] Int. Cl.[4] ..... C22C 32/00

[52] U.S. Cl. ..... 420/417; 75/230; 75/231; 420/418; 420/419; 420/420

[58] Field of Search ..... 420/417, 418, 419, 420; 75/230, 231, 252; 428/614

[56] References Cited

U.S. PATENT DOCUMENTS 2,819,958 11/1958 Abkowitz et al. ..... 420/420
3,379,522 4/1968 Vordahl ..... 420/417

FOREIGN PATENT DOCUMENTS 8644 3/1978 Japan ..... 420/417

*Primary Examiner*—L. Dewayne Rutledge
*Assistant Examiner*—Robert L. McDowell
*Attorney, Agent, or Firm*—Armstrong, Nikaido, Marmelstein & Kubovcik

[57] ABSTRACT

A free-cutting Ti alloy is disclosed. The basic alloy composition of this free-cutting Ti alloy essentially consists of at least one of S: 0.001–10%, Se: 0.001–10% and Te: 0.001–10%; REM: 0.01–10%; and one or both of Ca: 0.001–10% and B: 0.005–5%; and the balance substantially Ti. The Ti alloy includes one or more of Ti-S (Se, Te) compounds, Ca-S (Se, Te) compounds, REM-S (Se, Te) compounds and their complex compounds as inclusions to improve machinability. Some optional elements can be added to above basic composition.

Also disclosed are methods of producing the above free-cutting Ti alloy and a specific Ti alloy which is a particularly suitable material for connecting rods.

3 Claims, No Drawings

FREE-CUTTING TI ALLOY

This is a continuation-in-part of application Ser. No. 849,979, filed 4-10-86, now abandoned.

BACKGROUND OF THE INVENTION

1. Field of the Invention

The present invention relates to a titanium alloy with improved machinability and its method of production.

The titanium alloy of the present invention is suitable for a material in the production of, for example, connecting rods to connect automobile engine piston pins and crosshead pins with the crank, or connecting rods for industrial machines.

2. State of the Art

Pure titanium and titanium alloy combine the advantages of light weight and high strength, and are used particularly often as materials in aircraft. These advantages are also applicable in manufacturing automobile or electronic equipment parts and accessories, but because the processability, and especially the machinability, of both Ti and Ti alloys is inferior to that of conventional materials such as steel, the manufacture of parts for mass-produced goods has been difficult.

One way of improving the machinability of steel is to add S. But even if S is added to Ti or Ti alloys, improvements in machinability are not up to the anticipated level, and minuses such as deposition of tabular Ti-S compounds in the grain boundaries and decrease in toughness are conspicuous. For these reasons, up to now a method of improving the machinability, without reducing the properties, of Ti or Ti alloys has not been discovered.

Similar to the addition of Pb to steel to improve its machinability, Pb has been added to titanium alloys in tests to improve their machinability. However, the addition of Pb to titanium alloys is not an effective solution because most of the added Pb dissolves in matrix, and improvements in machinability are no greater than when Pb is added to steel.

For example, connecting rods to connect automobile engine piston pins and crosshead pins with the crank have conventionally used, for the most part, forged parts from iron-based materials. Because the density of iron-based materials is high, there is a limit to how light the connecting rods can be, which becomes an obstacle in the realization of elevation in fuel efficiency with a lightweight engine, or elevation in power through high-speed rotation.

Generally, among the important properties required for connecting rods used in automobiles, industrial machines, and the like, are (1) fatigue strength, (2) toughness, (3) abrasion resistance, and (4) machinability.

Ti alloys possess superior qualities which are able to meet these requirements, and Ti alloy connecting rods are being used for some special purposes (for example, racing cars). A typical alloy is a 6%Al - 4%V - Ti alloy.

However, conventional Ti alloy, starting with the above-mentioned 6%Al - 4%V - Ti composition, has a low thermal conductivity compared to iron-based materials presently being used for connecting rods, and for a high degree of hardness and high activity, workability is extremely poor. Accordingly, industrial production of a large amount of connecting rods using this alloy is difficult, and a particular problem is that the required fatigue strength which is most essential for the connecting rod is insufficient.

Because of this, it was necessary to improve the machinability and fatigue strength of Ti alloys in order to make use of them as connecting rod material in the mass production of automobiles, two-wheeled vehicles, industrial machines, etc.

SUMMARY OF THE INVENTION

One object of the present invention is to provide a Ti alloy with improved machinability without damaging the properties of Ti and Ti alloys.

Another object of the present invention is to provide a suitable method of producing the above-mentioned alloy.

Still another object of the present invention is to provide a Ti alloy for connecting rods that is remarkably superior to conventional Ti alloys and that is appropriate for general use.

DETAILED EXPLANATION OF PREFERRED EMBODIMENTS

The basic embodiment of the present invention is a free-cutting Ti alloy essentially consisting of: at least one member selected from the group consisting of S: 0.001–10%, Se: 0.001–10% and Te: 0.001–10%, with the total being up to 10% when two or more are included; REM: 0.005–10%; at least one member selected from the group consisting of Ca: 0.001–10% and B: 0.0005–5%; the balance being substantially Ti; and as inclusions to improve machinability at least one member selected from the group consisting of Ti-S (Se, Te ) compounds, Ca-S (Se, Te) compounds, REM-S (Se, Te) compounds and their complex compounds.

A modified embodiment of the present invention is a free-cutting Ti alloy essentially consisting of, in addition to the above-mentioned composition, at least one member selected from the group consisting of Al: up to 10%, Sn: up to 15%, Co: up to 10%, Cu: up to 5%, Ta: up to 15%, Mn: up to 10%, Hf: up to 10%, W: up to 10% or less, Si: up to 0.5%, Nb: up to 20%, Zr: up to 10%, Mo: up to 15%, V: up to 20%, and 0: up to 1%, with the total being up to 50% when two or more are included.

Another modified embodiment of the present invention is a free-cutting Ti alloy essentially consisting of, in addition to the above-mentioned composition, one or both of: Pb: up to 10% and Bi: up to 10%, with the total being up to 10% when two or more are included.

In addition to the above-noted basic composition, another embodiment using both of the two groups of optionally added elements falls within the scope of the free-cutting Ti alloy of the present invention.

When very small amounts of REM and Ca are added, sulfides in the Ti or Ti alloy containing S become granular, and without an accompanying decrease in toughness machinability is remarkably improved. This has been recognized not only for S, but similarly for Se and Te.

The roles of each of the components of the free-cutting titanium alloy of the present invention and reasons for limiting their compositions are as follows.

S: 0.001–10%, Se: 0.001–10%, Te: 0.001–10%, total up to 10%

Using these elements improves machinability. For this purpose, 0.001% or more of each is required. On the other hand, because hot workabilty decreases remarkably if large amounts are added, the upper limit of each is kept to 10%, and the total to 10% when two or more are added.

REM: 0.005–10%

The term "REM" refers to Sc, Y, and the lanthanide rare-earth metals (atomic numbers 57–71). These metals form stable compounds with S, Se and Te, inclusions become granular, and machinability is raised when these metals precipitate in the crystal grains as metal inclusions in the presence of B. The addition of 0.005% or more results in a rise in machinability without damaging toughness. An excessive amount results in lowered corrosion resistance and hardness, and prevents improvements in hot workability by B, so the upper limit is 10%.

Ca: 0.001–10%

Ca, as with REM, forms stable compounds with S, Se, and Te, and inclusions become granular. The same upper and lower limits as with REM were established.

B: 0.0005–5%

When REM is added to Ti or a Ti alloy, hot ductility is lowered, and hot working is difficult. Hot workability can be improved by adding B. While not totally clear, it is thought that precipitation of REM in the grain boundaries is controlled by B. It is necessary to add 0.0005% or more B in order to obtain improved hot workability. However, if a large amount is added, B itself forms inclusions and hot workability deteriorates, so the upper limit is 5%.

The function of the optionally added elements and the basis for selecting the above-noted compositions are noted below.

Al: up to 10%, Sn: up to 15%, Cr: up to 15%, Fe: up to Pd: up to 5%, Ni: up to 10%, Be: up to 10%, Co: up to 10%, Cu: up to 10%, Ta: up to 15%, Mn: up to 10%, Hf: up to 10%, W: up to 10%, Si: up to 0.5%, Nb: up to 20%.

These components form compounds with Ti and raise the hardness of the alloy. If their addition exceeds the upper limit, toughness is remarkably lowered. Furthermore, addition of Pd not only improves hardness but also corrosion resistance.

Zr: up to 10%, Mo: up to 15%, V: up to 20%

These components are added to control Ti alloy crystal grains and to obtain proper hardness and toughness. If their addition exceeds the upper limit, beta-phase stabilizes, and these purposes cannot be achieved.

O: up to 1%

The hardness of Ti and Ti alloys containing 0 rises significantly. On the other hand, toughness is sharply lowered, so the amount added must not be more than 1%.

Pb: up to 10%, Bi: up to 10%

The machinability of Ti alloys is improved when these elements are present along with S, Se, and Te. A disadvantage is that hot workability decreases and density increases. Therefore, upper limits of 10% and a total amoun not exceeding 10% when added together are preferred.

Suitable amounts of the above-noted optionally added elements somewhat differ depending on type, but as the amount added increases the density of the alloy rises, and the advantage of Ti alloys, lightness, is lost. In general, the amount added should be up to 5%.

Ti-S (Se, Te) compounds, REM-S (Se, Te) compounds, and Ca-S (Se, Te) compounds give effects when they are present in the form of particulate inclusions, and lose their reasons for being present if dissolved in the matrix. The size of the particles is generally in the range of 1–100 microns. Through rapid cooling at the time of casting, minute grains of 0.1 micron or less result, and through unsuitable ways of addition huge particles of 500 microns or more will occur. In both cases, the effect of the compounds is not appreciable.

One method of producing the Ti alloy of the present invention comprises melting, in a PPC (plasma progressive casting) furnace, the following ingredients: one or more (if more than two the total amount is up to 10%) of S: 0.001–10%, Se: 0.001–10%, and Te: 0.001–10%; REM: 0.005–10%; and one or both of Ca: 0.001–10% and B: 0.0005–5%; with the balance Ti.

A second method of producing the Ti alloy of the present invention comprises combining Ti-S (Se, Te) compounds, Ca-S (Se, Te) compounds, REM-S (Se, Te) compounds, and their complex compounds, as machinability-improving materials, with Ti and one or more (if more than two the total amount is up to 10%) of S: 0.001–10%, Se: 0.001–10%, and Te: 0.001–10%; REM: 0.005–10%; and one or both of Ca: 0.001–10% and B: 0.0005–5%.

Any other method of producing the Ti alloy of the present invention may be applied, but use of the above-noted PPC furnace for melting is ideal for supplying a uniform alloy with no segregation of ingredients, especially S (Se, Te), REM and Ca.

Nitrides or a large amount of oxides of Ti has a detrimental effect on the machinability of the alloy, and it is therefore preferable to refine the alloy by remelting in a vacuum furnace after melting in the above-noted PPC furnace.

Yields of S, Se and Te are low when they are added in the form of elements, because their boiling points are low, and changes in contents of the components easily become large. If these components are added in the form of compounds with Te, Ca and REM, yield is high, and a stabilized, uniform alloy can be obtained.

In addition to the melting method, powder metallurgy is also available for producing the Ti alloy of the present invention. The above-noted powder of machinability-improving materials and Ti alloy powder is mixed and sintered, and a product with similar properties can be obtained. Of course, the powder obtained from melted free-cutting titanium alloy can also be sintered.

The titanium of the present invention, with superior machinability, when used for connecting rods is basically composed of the following: Al: 2–4%; V: 1.5–2.5%; REM: 0.01–3.0%; and Ca, S, Se, Te and Pb: 0.01–1.0% each, total amount up to 5%; with the balance substantially Ti.

A modified embodiment of the titanium of the present invention, with superior machinability, when used for connecting rods is composed of one or more of all of the following, which are added to the above composition: Cu: up to 5%; one or more of Sn, Cr, Fe, Ni, Be, Co, Mn, Hf, W and Zr: up to 10% each; one or more of Nb, Ta and Mo: up to 15%; 0: up to 1%; with the balance substantially Te.

Reasons for selecting the above alloy compositions are as follows.

Al: 2–4%

Al is a Ti alpha-phase stabilizing element, and 2% or more is included because it is effective in elevating the hardness of the titanium alloy. If the amount is too large, machinability required in connecting rod production, and rotary fatigue strength and toughness, required in connecting rod use, are lowered, so the amount was limited to 4% or less.

V: 1.5–2.5%

V is a Ti beta-phase stabilizing element, and 1.5% or more is included because it is effective in elevating the hardness of the titanium alloy. If the amount is too large, machinability required in connecting rod production is inferior, along with a decrease in fatigue strength and toughness, so the amount was limited to 2.5% or less.

REM: 0.01–3.0%:

one or more of Ca, S, Se, Te, Pb and Bi: 0.01–1.0%

(total of REM, Ca, S, Se, Te, Pb and Bi: up to 5%)

REM, Ca, S, Se, Te, Pb and Bi all improve machinability of titanium alloy. As noted above, REM forms stable compounds with S, Se and Te, inclusions become granular, toughness is improved, and machinability is elevated. To obtain these results 0.01% or more is included, as needed. If a large amount is added, corrosion resistance of the titanium alloy and strength are lowered, so it is necessary to keep the amount to 3.0% or less. As noted above, Ca forms stable compounds with S, Se and Te, controls the shape of inclusions, and improves toughness and machinability of the titanium alloy. To obtain these results 0.01% or more is included, as needed. If a large amount is added, titanium alloy corrosion resistance and fatigue strength are lowered, so it is necessary to keep the amount to 1.0% or less. As noted above, S, Se, Te, Pb and Bi are all elements which elevate machinability of titanium alloy. To obtain these results 0.01% or more is included, as needed. If the amount is too large, hot workability of titanium alloy is remarkably lowered, so the amount of each element was kept to 1.0% or less. Finally, if the total amount of machinability-improving elements is too large, corrosion resistance, strength, and hot workability of the titanium alloy are lowered, so it is necessary to keep the total amount of REM, Ca, S, Se, Te, Pb and Bi to 5% or less.

Cu: 5% or less

Cu forms a compound with Ti, which raises the strength of the titanium alloy, and can be added as necessary. If the amount is too large, toughness of the titanium alloy is lowered, so it is necessary to keep the amount to 5% or less.

One or more of Sn, Cr, Fe, Ni, Be, Co, Mn, Hf, W and Zr: up to 10%

All of these elements form compounds with Ti and raise the strength of the titanium alloy. If the amount is too large, toughness of the titanium alloy is lowered, so the total amount is kept to 5% or less.

One or more of Nb, Ta and Mo: up to 15%

All of these elements control titanium alloy crystals and raise the strength of the alloy. If the amount is too large, beta-phase stabilizes, so in order to prevent this from happening it is necessary to keep the total amount to 15% or less.

0: 1% or less as above

EXAMPLE 1

Using a PPC furnace, Ti alloys with the compositions shown in Table 1 were melted, then forged into round bars 50mm in diameter, and annealed. Only, No. 10 was first melted in the PPC furnace and then melted again in a vacuum furnace, followed by the above forging and annealing. Also, No. 2 used CaS powder as the raw material, No. 5 used Ti-S compound powder, Ca-Te compound powder and REM-S compound powder as raw materials. The numbers marked with asterisks in the Table are comparative examples.

Microscopic observation of the structures revealed that the inclusions (Ti-S compounds, REM-S compounds) of No. 1 are granular, with an average diameter of 3 microns, and that the inclusions (Ti-S) of No. 6* are extremely large and tabular, and are precipitated in the grain boundaries.

Machinability of each test piece was tested under the following conditions:

Tool: 5 mm diameter drill

Feed: 0.05 mm/rev.

Hole Depth: 20 mm and expressed as 1000 mm life-speed. The term "1000 mm life-speed" means the drilling speed (rotating speed) at which the drill life is 1000 mm of total depth of the holes.

Machinability shown in Table 2 is expressed as a ratio, "drilling indices", which is a ratio of the 1000 mm life-speed of test piece No. 6, in which S is added to pure Ti, taken as the standard, "100".

In each of the groups of Examples and Comparisons of Table 2, all of those according to the present invention achieved better machinability.

The toughness of some of the test pieces was tested according to the Charpy test using JIS No. 4 test pieces. These results are also shown in Table 2.

TABLE 1

| | Alloy Composition | | | | | | | | | | |
|---|---|---|---|---|---|---|---|---|---|---|---|
| No. | S | Se | Te | REM | Ca | Al | Sn | V | O | Others | |
| 1 | 0.5 | — | — | 2.0 | — | — | — | — | — | — | |
| 2 | 0.2 | — | — | — | 0.5 | — | — | — | — | — | |
| 3 | — | 0.4 | — | 0.9 | — | — | — | — | — | — | |
| 4 | — | — | 1.0 | 0.5 | 0.7 | — | — | — | — | — | |
| 5 | 2.0 | 1.0 | 0.6 | 6.0 | 1.5 | — | — | — | — | — | |
| 6* | — | — | — | — | — | — | — | — | — | — | |
| 7* | — | — | — | 2.0 | — | — | — | — | — | — | |
| 8* | — | — | — | — | 0.6 | — | — | — | — | — | |
| 9* | 1.0 | — | — | — | — | — | — | — | — | — | |
| 10 | 1.0 | — | — | 2.0 | — | 6.0 | — | 4.0 | — | — | |
| 11* | — | — | — | — | — | 5.9 | — | 4.0 | — | — | |
| 12 | 0.5 | 0.5 | — | — | 1.1 | 2.5 | 11.0 | — | — | Zr: 5.0 | Fe: 0.1 Si: 0.2 |
| 13* | — | — | — | — | — | 2.6 | 11.0 | — | — | Zr: 4.8 | Fe: 0.1 Si: 0.25 |
| 14 | 1.2 | — | — | 3.0 | — | 5.9 | — | — | — | Mo: 0.8 | Nb: 1.9 Fe: 0.2 Ta: 1.1 |
| 15* | — | — | — | — | — | 6.1 | — | — | — | Mo: 0.8 | Nb: 2.0 Fe: 0.2 Ta: 1.0 |
| 16 | 0.5 | — | — | 1.0 | 0.5 | — | — | — | — | Pb: 0.2 | |
| 17* | — | — | — | — | — | — | — | — | — | Pb: 0.2 | |
| 18 | 0.5 | — | — | 4.0 | — | — | — | — | — | Mo: 0.3 | Fe: 0.3 Ni: 0.8 |
| 19* | — | — | — | — | — | — | — | — | — | Mo: 0.3 | Fe: 0.2 Ni: 0.8 Mn: 7.8 |
| 20 | 0.6 | — | — | 1.0 | — | — | — | — | — | Mn: 7.8 | |
| 21* | — | — | — | — | — | — | — | — | — | Mn: 7.8 | |

TABLE 1-continued

| No. | S | Se | Te | REM | Ca | Al | Sn | V | O | Others | | | |
|---|---|---|---|---|---|---|---|---|---|---|---|---|---|
| | Alloy Composition | | | | | | | | | | | | |
| 22 | 0.5 | — | — | 1.0 | — | 6.0 | — | 4.0 | — | Co: 0.2 W: 0.1 | Cu: 0.1 | Be: 0.1 | Hf: 0.1 |
| 23* | — | — | — | — | — | 6.0 | — | 4.0 | — | Co: 0.2 W: 0.1 | Cu: 0.1 | Be: 0.1 | Hf: 0.1 |
| 24 | 0.5 | — | — | 1.0 | — | 6.0 | — | 4.0 | 0.2 | — | | | |
| 25* | — | — | — | — | — | 6.0 | — | 4.0 | 0.2 | — | | | |
| 26 | 0.7 | — | — | 1.5 | — | 3.0 | — | 13.0 | — | Cr: 11.0 | Fe: 0.3 | | |
| 27* | — | — | — | — | — | 3.0 | — | 12.5 | — | Cr: 11.5 | Fe: 0.3 | | |
| 28 | 0.5 | 0.2 | — | 1.0 | — | — | — | — | — | Pb: 1.0 | | | |
| 29 | 0.5 | — | — | — | 1.5 | — | — | — | — | Bi: 0.5 | | | |
| 30 | 0.5 | — | 0.3 | 1.0 | — | — | — | — | — | Pb: 0.5 | Bi: 0.5 | | |
| 31* | — | — | — | — | — | — | — | — | — | Pb: 1.0 | | | |
| 32* | — | — | — | — | — | — | — | — | — | Bi: 0.5 | | | |

TABLE 2

| No. | Drilling Index | Charpy Impact Value (Kgf/cm$^2$) |
|---|---|---|
| 1 | 180 | 8.0 |
| 2 | 140 | 8.0 |
| 3 | 170 | 8.1 |
| 4 | 220 | 8.0 |
| 5 | 250 | 7.9 |
| 6* | 100 | 8.0 |
| 7* | 110 | 5.9 |
| 8* | 105 | 7.7 |
| 9* | 110 | 1.0 |
| 10 | 95 | 1.6 |
| 11* | 40 | 1.5 |
| 12 | 100 | — |
| 13* | 45 | — |
| 14 | 110 | — |
| 15* | 46 | — |
| 16 | 145 | — |
| 17* | 90 | — |
| 18 | 110 | — |
| 19* | 65 | — |
| 20 | 110 | — |
| 21* | 45 | — |
| 22 | 55 | — |
| 23* | 30 | — |
| 24 | 60 | — |
| 25* | 35 | — |
| 26 | 50 | — |
| 27* | 25 | — |
| 28 | 200 | — |
| 29 | 190 | — |
| 30 | 210 | — |
| 31* | 115 | — |
| 32* | 110 | — |

EXAMPLE 2

Using a PPC furnace, Ti alloys with the compositions shown in Table 3 were melted, and a powder with an average grain diameter of 100 microns was produced using the rotating electrode method.

From this powder a 60 mm diameter, 100 mm long, cylindrical compact was formed.

This compact was sintered in a vacuum furnace for 5 hours at 850° C., and 30 mm diameter round bars were forged and annealed.

As in Example 1, machinability and toughness tests were carried out on the test pieces. These results are shown in Table 4.

The test data of Table 4 show remarkable improvements in Ti and Ti alloy machinability, without harming toughness.

Thus, machine processing of Ti becomes easy, mass production of industrial parts is made possible, all types of industrial products are lightened, and the use of Ti is enlarged.

TABLE 3

| No. | S | Se | Te | REM | Ca | Al | Sn |
|---|---|---|---|---|---|---|---|
| | Alloy Composition | | | | | | |
| 33 | 0.4 | — | — | 1.5 | — | — | — |
| 34 | — | 0.4 | — | 1.2 | — | — | — |
| 35 | 1.0 | 1.0 | 0.5 | 4.0 | 2.1 | — | — |
| 36* | — | — | — | — | — | — | — |
| 37* | 0.5 | — | — | — | — | — | — |
| 38* | — | — | — | 2.0 | — | — | — |
| 39* | 1.0 | — | — | — | 2.0 | 5.8 | 4.0 |
| 40 | 1.5 | — | — | 1.2 | — | 6.0 | 3.7 |
| 41* | — | — | — | — | — | 6.0 | 4.1 |

TABLE 4

| No. | Drilling Index | Charpy Impact Value (Kgf/cm$^2$) |
|---|---|---|
| 33 | 170 | 7.3 |
| 34 | 170 | 7.3 |
| 35 | 240 | 7.1 |
| 36* | 95 | 7.2 |
| 37* | 100 | 1.2 |
| 38* | 105 | 6.0 |
| 39* | 90 | 1.4 |
| 40 | 95 | 1.3 |
| 41* | 35 | 1.3 |

EXAMPLE 3

Titanium alloys with the compositions shown in Table 5 were melted using a PPC furnace, then forged into round bars 50 mm in diameter, and annealed. Only, No. 110 was first melted in the PPC furnace and then melted again in a vacuum furnace, followed by the above forging and annealing. The numbers marked with asterisks in the Table are comparative examples.

Machinability of each test piece was tested under the following conditions:

Tool: 5 mm diameter drill

Feed: 0.05 mm/rev.

Hole Depth: 20 mm and expressed as 1000 mm life-speed. The term "1000 mm life-speed" means the drilling speed (rotating speed) at which the drill life is 1000 mm of total depth of the holes.

Machinability shown in Table 6 is expressed as a ratio, "drilling indices", which is a ratio of the 1000 mm life-speed of pure titanium test piece No. 104, taken as the standard.

Also, the absence or presence of cracking during hot forging was checked in each test piece, and the results are shown in Table 6.

As can be seen from Table 6, for the Comparative Examples in which only REM is added to Ti or Ti alloys (Nos. 105* and 109*), although machinabilty improved, cracking due to forging occurred, but that for all of the Examples in which REM and B were added, in addition to improved machinability, no cracking occurred during hot working, clearly revealing the effect of adding B.

As explained above, the present invention is able to provide a free-cutting Ti alloy with superior hot workability, making the most use of the many special qualities of Ti alloys.

EXAMPLE 4

Ti alloys with the chemical compositions shown in Table 7 were melted in a PPC furnace. After casting into an ingot, 50 mm in diameter round bars were forged and annealed, and test pieces were prepared. No. 216 is the Comparative Example.

Next, machinability and rotary fatigue tests were carried out on each test piece.

TABLE 5

| | Alloy Composition | | | | | | | | | |
|---|---|---|---|---|---|---|---|---|---|---|
| No. | REM | B | Al | Sn | V | O | Others | | | |
| 101 | 0.05 | 0.003 | — | — | — | — | — | | | |
| 102 | 0.50 | 0.005 | — | — | — | — | — | | | |
| 103 | 2.35 | 0.050 | — | — | — | — | — | | | |
| 104* | — | — | — | — | — | — | — | | | |
| 105* | 0.05 | — | — | — | — | — | — | | | |
| 106 | 0.05 | 0.050 | 3.1 | — | 2.1 | — | — | | | |
| 107 | 0.30 | 0.014 | 3.0 | — | 2.1 | — | — | | | |
| 108* | — | — | 3.3 | — | 2.3 | — | — | | | |
| 109* | 0.04 | — | 3.2 | — | 2.3 | — | — | | | |
| 110 | 0.25 | 0.015 | 6.2 | — | 4.3 | — | — | | | |
| 111* | — | — | 6.1 | — | 4.1 | — | — | | | |
| 112 | 0.19 | 0.008 | 2.6 | 11.0 | — | — | Zr: 5.1 | Fe: 0.15 | Si: 0.2 | |
| 113* | — | — | 2.5 | 11.0 | — | — | Zr: 4.8 | Fe: 0.12 | Si: 0.25 | |
| 114 | 0.22 | 0.004 | 6.1 | — | — | — | Mo: 0.8 | Nb: 1.8 | Fe: 0.22 | Ta: 1.1 |
| 115* | — | — | 6.1 | — | — | — | Mo: 0.8 | Nb: 1.8 | Fe: 0.22 | Ta: 1.0 |
| 116 | 0.16 | 0.004 | — | — | — | — | Pd: 0.2 | | | |
| 117* | — | — | — | — | — | — | Pd: 0.2 | | | |
| 118 | 0.31 | 0.095 | — | — | — | — | Mo: 0.4 | Fe: 0.35 | Ni: 0.8 | |
| 119* | — | — | — | — | — | — | Mo: 0.4 | Fe: 0.28 | Ni: 0.8 | Mn: 7.8 |
| 120 | 0.45 | 0.325 | — | — | — | — | Mn: 7.8 | | | |
| 121* | — | — | — | — | — | — | Mn: 7.8 | | | |
| 122 | 0.26 | 1.432 | 6.2 | — | 4.2 | — | Co: 0.2<br>W: 0.1 | Cu: 0.1 | Be: 0.1 | Hf: 0.1 |
| 123* | — | — | 6.1 | — | 4.2 | — | Co: 0.2<br>W: 0.1 | Cu: 0.1 | Be: 0.1 | Hf: 0.1 |
| 124 | 0.28 | 0.038 | 6.3 | — | 4.2 | 0.2 | — | | | |
| 125* | — | — | 6.2 | — | 4.1 | 0.2 | — | | | |
| 126 | 0.30 | 0.443 | 3.2 | — | 13.0 | — | Cr: 11.0 | Fe: 0.32 | | |
| 127* | — | — | 3.1 | — | 12.8 | — | Cr: 11.5 | Fe: 0.34 | | |

TABLE 6

| No. | Drilling Index | Cracking due to Forging |
|---|---|---|
| 101 | 140 | no |
| 102 | 160 | no |
| 103 | 190 | no |
| 104* | 100 | no |
| 105* | 130 | yes |
| 106 | 110 | no |
| 107 | 120 | no |
| 108* | 60 | no |
| 109* | 100 | yes |
| 110 | 90 | no |
| 111* | 40 | no |
| 112 | 95 | no |
| 113* | 45 | no |
| 114 | 110 | no |
| 115* | 46 | no |
| 116 | 145 | no |
| 117* | 90 | no |
| 118 | 108 | no |
| 119* | 65 | no |
| 120 | 109 | no |
| 121* | 45 | no |
| 122 | 60 | no |
| 123* | 30 | no |
| 124 | 62 | no |
| 125* | 35 | no |
| 126 | 52 | no |
| 127* | 25 | no |

Machinability tests were carried out under the following conditions:

Tool: SKH9 5 mm diameter drill

Feed: 0.05 mm/rev.

Hole Depth: 20 mm

Lubricating Oil: Water-soluble Machining Oil and expressed as a "drill life-speed ratio, which is a ratio of the 1000 mm life-speed of the test pieces to that of the comparative material, 6%Al - 4%V - Ti alloy, taken as the standard, "100". The results are shown in Table 8.

The rotary fatigue test was carried out using an Ono-type rotary fatigue test machine, by determining limits of fatigue of annealed, smooth test pieces. Evaluation was made with fatigue strength ratios compared with the fatigue limit of 6%Al - 4%V - Ti alloy, taken as the standard, "100". The results of this test are also shown in Table 8.

As shown in Table 8, with the Ti alloys of the present invention (Nos. 201–215), drill life-speed ratio is high compared to that of the Comparative Example (No. 216), machinability is superior to a conventional 6%Al -4%V - Ti alloy, and in particular the manufacturability of connecting rods is raised considerably. Also, rotary fatigue strength required for connecting rods is markedly superior to conventional Ti alloys and an even higher degree of lightness is possible, not only from the aspect of density but also strength, contributing to elevations in the lightness and power of automobile engines.

TABLE 7

| No. | Al | V | REM | Ca | S | Se | Te | Others | | | |
|---|---|---|---|---|---|---|---|---|---|---|---|
| | Alloy Composition | | | | | | | | | | |
| 201 | 3.0 | 2.0 | — | — | — | — | — | — | | | |
| 202 | 2.5 | 1.7 | — | — | — | — | — | — | | | |
| 203 | 3.5 | 2.3 | — | — | — | — | — | — | | | |
| 204 | 3.0 | 2.0 | 1.0 | — | 0.5 | — | — | — | | | |
| 205 | 3.0 | 2.0 | 1.0 | — | 0.5 | 0.5 | — | — | | | |
| 206 | 3.0 | 2.0 | 1.0 | 0.5 | 0.5 | 0.5 | 0.5 | — | | | |
| 207 | 3.0 | 2.0 | 1.0 | — | 0.5 | — | — | Bi: 0.5 | | | |
| 208 | 3.0 | 2.0 | 1.0 | — | 0.5 | — | — | Pb: 0.2 | O: 0.1 | | |
| 209 | 3.0 | 2.0 | 3.0 | — | 2.0 | 0.2 | — | Sn: 4.0 | Cu: 2.0 | Cr: 5.0 | O: 0.1 |
| 210 | 3.0 | 2.0 | 2.0 | — | 1.0 | — | — | Fe: 0.5 | Ni: 2.0 | O: 0.1 | |
| 211 | 3.0 | 2.0 | 2.1 | — | 1.3 | — | 0.5 | Be: 0.4 | Co: 2.0 | O: 0.1 | |
| 212 | 3.0 | 2.0 | 1.5 | — | 0.7 | — | — | Mn: 7.0 | W: 0.1 | O: 0.1 | |
| 213 | 3.0 | 2.0 | 1.1 | — | 0.5 | — | — | Hf: 0.1 | Zr: 5.0 | O: 0.1 | |
| 214 | 3.0 | 2.0 | 1.0 | — | 0.5 | — | — | Pb: 0.1 | Fe: 0.5 | Bi: 0.1 | Ni: 2.0 |
| 215 | 3.0 | 2.0 | 1.2 | — | 0.4 | 0.4 | — | Ta: 3.1 | Mo: 0.5 | O: 0.1 | |
| 216° | 6.0 | 4.0 | — | — | — | — | — | — | | | |

TABLE 8

| No. | Drill Life-Speed Ratio | Rotary Fatigue Strength Ratio |
|---|---|---|
| 201 | 250 | 130 |
| 202 | 270 | 128 |
| 203 | 230 | 133 |
| 204 | 430 | 120 |
| 205 | 480 | 110 |
| 206 | 530 | 102 |
| 207 | 530 | 101 |
| 208 | 480 | 102 |
| 209 | 380 | 102 |
| 210 | 350 | 105 |
| 211 | 400 | 101 |
| 212 | 390 | 100 |
| 213 | 350 | 101 |
| 214 | 450 | 100 |
| 215 | 350 | 105 |
| 216° | 100 | 100 |

What is claimed is:

1. A free-cutting Ti alloy consisting of at least one member selected from the group consisting of S: 0.001–10%, Se: 0.001–10% and Te: 0.001–10%, with the total being up to 10% when two or more are included; REM: 0.005–10% and Ca: 0.001–10%; the balance being substantially Ti; and at least one member selected from the group consisting of Ti-S (Se, Te) compounds, Ca-S (Se, Te) compounds, REM-S (Se, Te) compounds, and their complex compounds, as inclusions to improve machinability; the inclusions being particulates having an average diameter of 1–100 microns.

2. A free-cutting Ti alloy consisting of at least one member selected from the group consisting of S: 0.001–10%, Se 0.001–10% and Te: 0.001–10%, with the total being up to 10% when two or more are included; REM: 0.005–10%; Ca: 0.001–10%; and at least one member selected from the group consisting of Al: up to 10%, Sn: up to 15%, Co: up to 10%; Cu: up to 5%, Ta: up to 15%, Mn: up to 10%; Hf: up to 10%, W: up to 10%, Si: up to 0.5%; Nb: up to 20%; Zr: up to 10%; Mo: up to 15%; V: up to 20%; and O: up to 1%, with the total being up to 50% when two or more are included; the balance being substantially Ti; and at least one member selected from the group consisting of Ti-S (Se, Te) compounds, Ca-S (Se, Te) compounds, REM-S (Se, Te) compounds, and their complex compounds, as inclusions to improve machinability; the inclusions being particulates having an average diameter of 1–100 microns.

3. A free-cutting Ti alloy consisting of at least one member selected from the group consisting of S: 0.001–10%, Se: 0.001–10% and Te: 0.001–10%, with the total being up to 10% when two or more are included; REM: 0.005–10%; Ca: 0.001–10%; and one or both of Pb; up to 10% and Bi: up to 10%, with the total being up to 10% when two are included the balance being substantially Ti; and at least one member selected from the group consisting of Ti-S (Se, Te) compounds, Ca-S (Se, Te) compounds, REM-S (Se, Te) compounds, and their complex compounds, as inclusions to improve machinability; the inclusions being particulates having an average diameter of 1–100 microns.

* * * * *